United States Patent [19]

Baris et al.

[11] Patent Number: 4,574,986

[45] Date of Patent: Mar. 11, 1986

[54] FLEXIBLE CONTAINER SYSTEM

[75] Inventors: Albert S. Baris, Suffern; Peter J. Regna, Tuxedo Park, both of N.Y.

[73] Assignee: Aero Tec Laboratories, Inc., Ramsey, N.J.

[21] Appl. No.: 467,910

[22] Filed: Feb. 18, 1983

[51] Int. Cl.[4] ..... B65D 35/22

[52] U.S. Cl. ..... 222/94; 105/358; 410/68; 220/404

[58] Field of Search ..... 222/92, 105, 95, 183, 222/94; 150/55; 383/3; 220/403, 404, 402, 401, 461, 462, 463, 85 B; 206/522; 105/358, 359, 355, 238 R; 410/68, 52

[56] References Cited

U.S. PATENT DOCUMENTS

| | | | |
|---|---|---|---|
| 2,439,562 | 4/1948 | Cunningham | 220/461 |
| 3,146,017 | 8/1964 | Yeary | 410/68 |
| 3,155,305 | 11/1964 | Bergstrom | 220/461 |
| 3,250,742 | 5/1966 | Nalpas | 105/238 R |
| 3,811,460 | 5/1974 | Capdevielle et al. | 220/85 B |
| 3,815,772 | 6/1974 | Elmore et al. | 222/105 |
| 3,918,604 | 11/1975 | Kersten | 220/85 B |
| 4,135,635 | 1/1979 | Fujii et al. | 220/85 B |
| 4,409,919 | 10/1983 | Strain | 220/85 B |

FOREIGN PATENT DOCUMENTS

| | | | |
|---|---|---|---|
| 1134627 | 4/1960 | Fed. Rep. of Germany . | |
| 1952430 | 10/1969 | Fed. Rep. of Germany . | |
| 2748914 | 3/1979 | Fed. Rep. of Germany . | |
| 1100852 | 4/1955 | France | 220/85 B |
| 1257065 | 2/1961 | France . | |

*Primary Examiner*—Joseph J. Rolla
*Assistant Examiner*—Kenneth Noland
*Attorney, Agent, or Firm*—Carella, Byrne, Bain & Gilfillan

[57] ABSTRACT

Flexible container apparatus for shipping fluids within a rigid transport container wherein a pair of flexible containers having transverse dimensions equal to or slightly greater than the width dimension of the rigid cargo container permits stable transport of the fluid and reuse of the rigid container on the return trip.

4 Claims, 7 Drawing Figures

FLEXIBLE CONTAINER SYSTEM

BACKGROUND OF THE INVENTION

This invention relates to flexible containers for shipping fluids. More specifically, this invention relates to flexible containers for shipping fluids, which containers are receivable within rigid containers, e.g. standard cargo containers, over the road trucks and aircraft cargo containers, and which flexible containers may be used within such rigid containers without structural modification or the addition of rigging fittings such as hooks, eyes, tie-downs and the like.

In modern transportation techniques the transport of liquids ordinarily has required the use of rigid containers, e.g. barrels or drums within other rigid containers or the dedication of liquid storage vehicles to the task. Such dedicated vehicles for the most part comprise tank wagons or tank trucks. Ordinarily barrels or other rigid containers are discarded or returned empty. Similarly, the use of dedicated vehicles ordinarily results in the transport of fluid in one direction and return of the vehicle empty (dead-heading) for subsequent use. As is well recognized in this industry, in addition to the cost incidental to dead-heading, vehicles or containers which are dedicated to such fluid use are expensive to purchase, expensive to clean and expensive to operate.

It has been proposed, from time-to-time, that a solution to dedicated vehicles for the transport of fluid is to provide a collapsible member or bladder within the transport means. Thus, a typical modern transport means comprises a standard cargo container e.g. a cargo container approximately 20 feet in length. Ordinarily, such containers are utilized for dry goods shipments. However, they are sometimes used to transport fluids. Where they are to be used to transport fluids a flexible tank may be provided within the cargo container and secured therein by lines or other means cooperating with hooks and/or eyes disposed on the inner surfaces of the containers. Such hooks and/or eyes must be installed for purposes of transporting the fluid and frequently must be removed before utilization of the container for dry cargo because they interfere with the volumetric shape of the cargo area.

Typical flexible shipping containers are shown in U.S. Pat. No. 2,672,902 to Prager, U.S. Pat. No. 2,969,102 to Cunningham, U.S. Pat. No. 3,578,050 to Weingarten, et al. and U.S. Pat. No. 2,437,058 to Waters.

One of the problems experienced with respect to the use of known flexible tank means is that the flexible tanks permit sloshing and hurling of the contained fluids. Such sloshing and hurling result in dangerous out-of-balance conditions, sometimes equating to free surface effect. The result is significant instability in the load which can, and sometimes does, result in instability of the vehicle carrying the load with the possibility of accident and injury.

With respect to the use of rigid containers within containers, e.g. the use of 55 gallon drums within rigid cargo containers, there is a significant waste of space. Such lack of space utilization has been observed to be as much as fifty to seventy percent of available cargo space.

SUMMARY OF THE INVENTION

It is an object of the present invention, therefore, to provide a flexible container system which will permit rigid transport containers such as conventional cargo containers, truck trailers, air cargo containers and the like, without structural modification, to be used for the safe and stable transportation of fluids.

Another object of the present invention is to provide a flexible container system which may be collapsed and stored in a relatively small volume when not in use so as to avoid "dead-heading."

A further object of the present invention is to provide a flexible container system for use with conventional cargo containers which substantially eliminates fluid dynamic problems such as sloshing and hurling during movement.

An additional object of the present invention is to provide a flexible container system which is economical to manufacture, easy to maintain, and operable by a single person.

Yet another object of the present invention is to provide a flexible container system which substantially eliminates the development of vapor between the top surface of the fluid and the inner surface of the container.

Still another object of the present invention is to provide a flexible container system which is adaptable for use in the transport of special fluids such as foods, fuels, chemicals and the like. These and other objects are achieved by the flexible container system of the present invention, one embodiment of which may include a first flexible container, a second flexible container wherein the first and second flexible containers are generally cylindrical in shape and have a longitudinal axial dimension which is substantially equal to the dimension of a rigid container into which the flexible containers are to be received and a diametric dimension which is substantially one-half the width of the rigid container into which the flexible containers are to be received.

BRIEF DESCRIPTION OF THE DRAWINGS

A more complete understanding of the present invention may be had from the following detailed description thereof, particularly when read in light of the accompanying drawings wherein.

DETAILED DESCRIPTION

As noted above this invention relates to a flexible container system for use in transporting fluids. In particular, this invention relates to a flexible container system which is uniquely adapted for use in transporting fluids in rigid transport containers such as conventional cargo containers, over the road trucks, railcars, aircraft cargo containers and the like.

Figure 1:
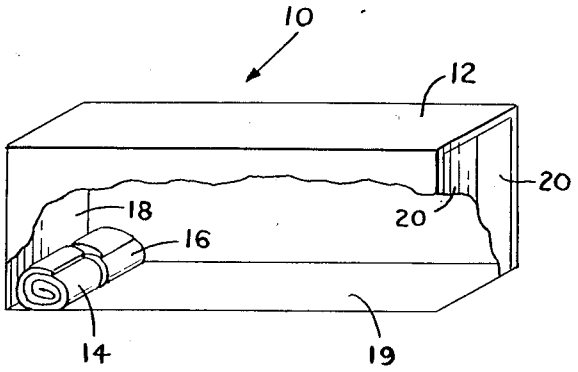
FIG. 1 is a schematic view, partially cut away, showing a flexible container system in accordance with the teaching of the present invention in stored position within a standard cargo container.

Referring therefore to FIG. 1, a flexible container system in accordance with the present invention is designated generally by the reference numeral 10 and shown in stored position within a standard rigid cargo container 12. Flexible container system 10 comprises a first flexible container 14 and a second flexible container 16. Flexible containers 14 and 16 can be seen to be rolled and stored at the closed end 18 of cargo container 12.

With flexible containers 14 and 16 in the stored positions shown in FIG. 1, rigid cargo container 12 may be utilized for transporting dry loads or other materials or products. This facility permits use of the container during return of the flexible container system from a delivery. In the past it has often been required to return such a container empty, i.e. to "dead-head." The economic benefits of this, of course, are clear.

Figure 2:
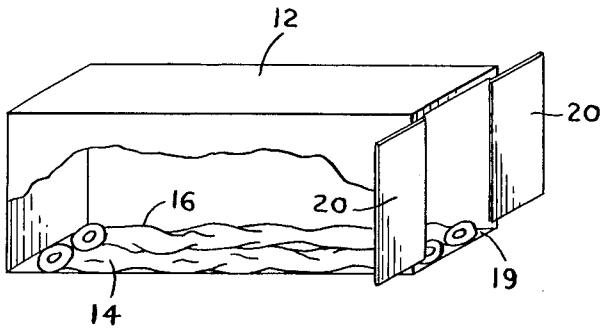
FIG. 2 is a schematic view, similar to FIG. 1, showing the cargo container doors open and a flexible container system according to the present invention in position for being filled.

In FIG. 2, flexible containers 14 and 16 are shown as having been unrolled and laid out along the floor 19 of cargo container 12. Doors 20 of cargo container 12 are shown in their open position so as to gain access to flexible containers 14 and 16 for purposes of filling. With flexible containers 14 and 16 in the positions shown in FIG. 2, the system is ready to be rigged for filling as is discussed below in detail.

At this point it may be desired to pre-inflate the containers 14 and 16 with air so as to facilitate their positioning by a single worker and also to avoid such problems as trapping one container under the other and the like. Such pre-inflation may be achieved by pumping air, e.g. the discharge from a vacuum cleaner, into the containers through their vents 36. With the containers pre-inflated in this manner filling is simplified and the handling process made easier.

Figure 3:
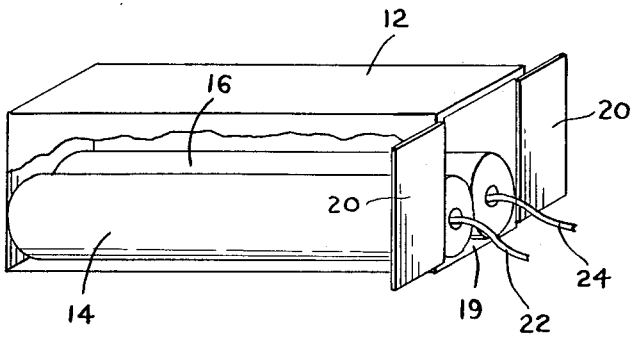
FIG. 3 is a view similar to FIG. 2 but showing a flexible container system in accordance with the invention during filling.

As schematically may be seen in FIG. 3, filling of flexible containers 14 and 16 is achieved by connecting first container 14 to a filling hose 22 and second flexible container 16 to a filling hose 24. Filling hose 22 and 24 receive fluid from a filling source either by gravity or by pumping.

Figure 4:
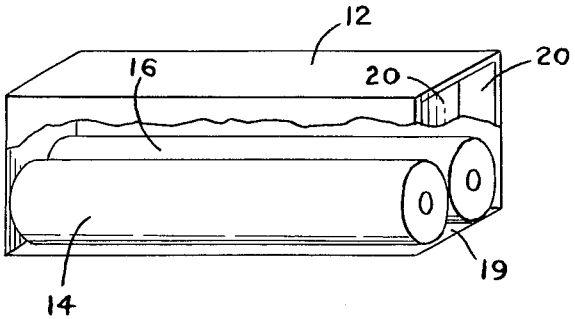
FIG. 4 is a view similar to FIG. 1 showing a flexible container system in accordance with the invention filled and in position for shipment.

Once the flexible containers 14 and 16 are filled, filling hoses 22 and 24 are removed, doors 20 are closed and secured and the container is ready for transport, see FIG. 4. In this regard, it should be noted that the flexible fluid container system according to the invention requires no hold-down means, lashing, netting or other devices to effect transport stability. The geometry i.e. cylindrical shape of the containers and the way they fit within the rigid cargo container have been shown to provide fully acceptable stable transport capabilities.

Figure 5:
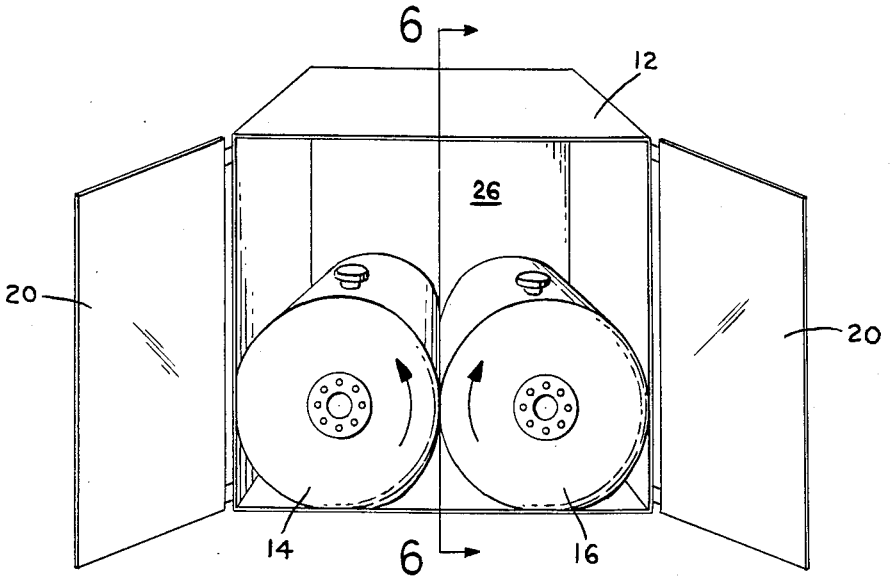
FIG. 5 is an end view of a standard rigid cargo container with a flexible container system according to the present invention installed and filled.
Figure 6:
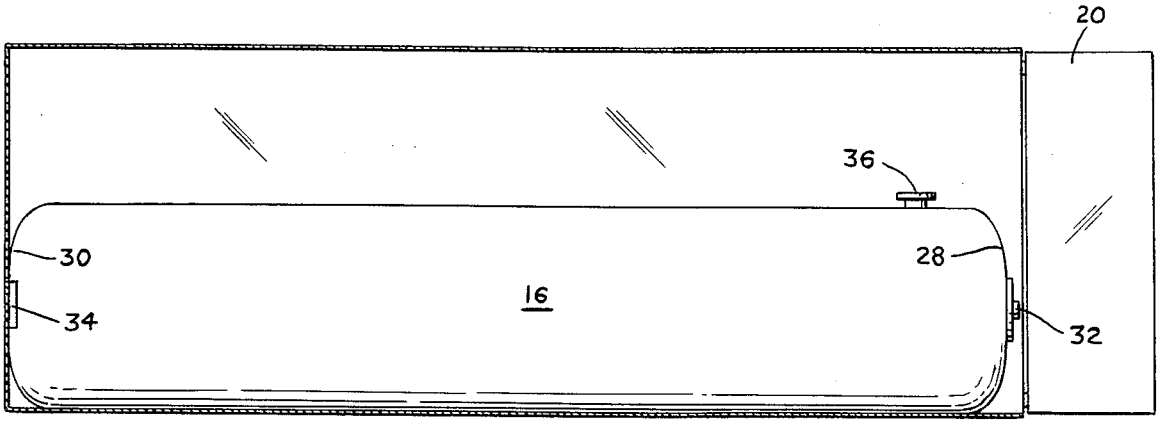
FIG. 6 is an elevational view through the plane 6—6 of FIG. 5.

Referring now to FIGS. 5 and 6, a flexible fluid container system structured according to the invention is shown in filled condition within a standard cargo container 12. The fluid container system including first and second flexible containers 14 and 16 are shown as being received within the cargo cavity 26 of container 12. As will be recognized by those skilled in these arts, the internal dimensions of cargo cavity 26 for a standard 20 foot container are length-20 feet, width-8 feet, and height-8 feet. In order for flexible containers 14 and 16 to be received within cavity 26 in accordance with the teaching of the present invention such as to maintain dynamic stability during transport, containers 14 and 16 have been found to be acceptable when manufactured in a generally cylindrical shape, to be 19 feet long and 4 and one-tenth feet in diameter. Thus, the sum of the diameters of containers 14 and 16 when the containers are filled and there is no restriction on the expansion of the containers is a number which is slightly larger than the width of the cavity 26 of container 12. Accordingly, when flexible containers 14 and 16 are positioned within cavity 26 and filled to capacity, they establish a firm surface-to-surface engagement with each other and also with the sides of container 12 whether they be smooth or corregated. These contacts cause the containers to be retained firmly within the cavity and facilitate transport.

As a direct consequence of the firm surface-to-surface engagement of one flexible container 14 or 16 with the other and with the sides of the cargo container walls, each flexible container 14 or 16 has the effect of stabilizing the other flexible container should either experience a rotational thrust. This may arise if the cargo container 12 is tilted or rolled about its longitudinal dimension. For example, referring to FIG. 5, should the cargo container 12 roll towards the left, flexible container 14 would have a tendency to rotate in a counter-clockwise direction. At the point where flexible container 14 and flexible container 16 meet, the rolling movement of flexible container 14 would impart an upward force to flexible container 16 by virtue of friction between the two, preventing the latter from rotating in the same direction, but rather urging it (flexible container 16) to rotate in the opposite (clockwise) direction in cog-like fashion as indicated by the arrow. Thus, instead of both flexible containers 14 and 16 rolling towards the left, the flexible containers 14 and 16 would try to push away from each other. However, on account of the firm surface-to-surface engagement with each other and the inner surfaces of the cargo container 12, the flexible containers 14 and 16 basically remain in place and overall stability is achieved.

With particular reference to the structure of flexible containers 14 and 16, each, when filled, tends to be a generally cylindrical member with closed ends. Thus, with particular reference to FIGS. 5 and 6, container 16 can be seen to be a generally cylindrical member having a first closed end 28 and a second closed end 30.

First closed end 28 is provided with a fill-discharge fitting 32 which is chosen from any of those generally known in the industry based upon the type hose or piping connections to be utilized. Second closed end 30 is provided with a cleanout plate 34 which again may be chosen from any of those known generally in the industry. Mounted on the upper surface of container 16 is a pressure relief vent means which again may be any of those generally known in the industry for venting fluid containing tanks. Flexible container 16 may be manufactured from any of a number of known materials for example rubber or flexible plastic reinforced with fabric or fibers, e.g. butyl, buna-N, Urethane PVC or chloroprene, each reinforced with nylon, polyester, aramid, cotton, fiberglass and the like.

In use, filling of the flexible containers is achieved by connecting filling connectors such as hoses 22 and 24 to the filling connections of the containers and filling the containers while they are in place within a rigid cargo container. The containers are filled to capacity which is indicated by a slight discharge of fluid from the vent system. When full, due to the weight of the liquid and the tension of the fabric pressing against the adjacent containers as well as the walls of the rigid container, the system is locked into the container allowing no significant movement. Off loading of the contained fluid is accomplished by connecting a suitable line to the fill-discharge connection of each container and utilizing a pump or siphon drain in accordance with well-known techniques. The cylinders may be emptied either one at a time or concurrently and in the process they collapse. In their collapsed state, refolding and storage is a simple one-man operation with the folded cylinders occupying a fraction of their filled volume thereby permitting utilization of the rigid cargo container for other cargo on a return trip.

From time-to-time there may be desire to clean the cylinders. In such instances each container is removed and both the fill-discharge means as well as the clean-out port are removed. The container may then be hung vertically with the fill-discharge port in the upper position. A suitable hose or high pressure rotating washing head may thereafter be passed through the bag using the fill-discharge port for access. Drainage of cleaning fluid occurs through the clean-out port at the lowest end of the container and the container may then be left to dry or suitable ventilation type drying means may be utilized.

Figure 7:
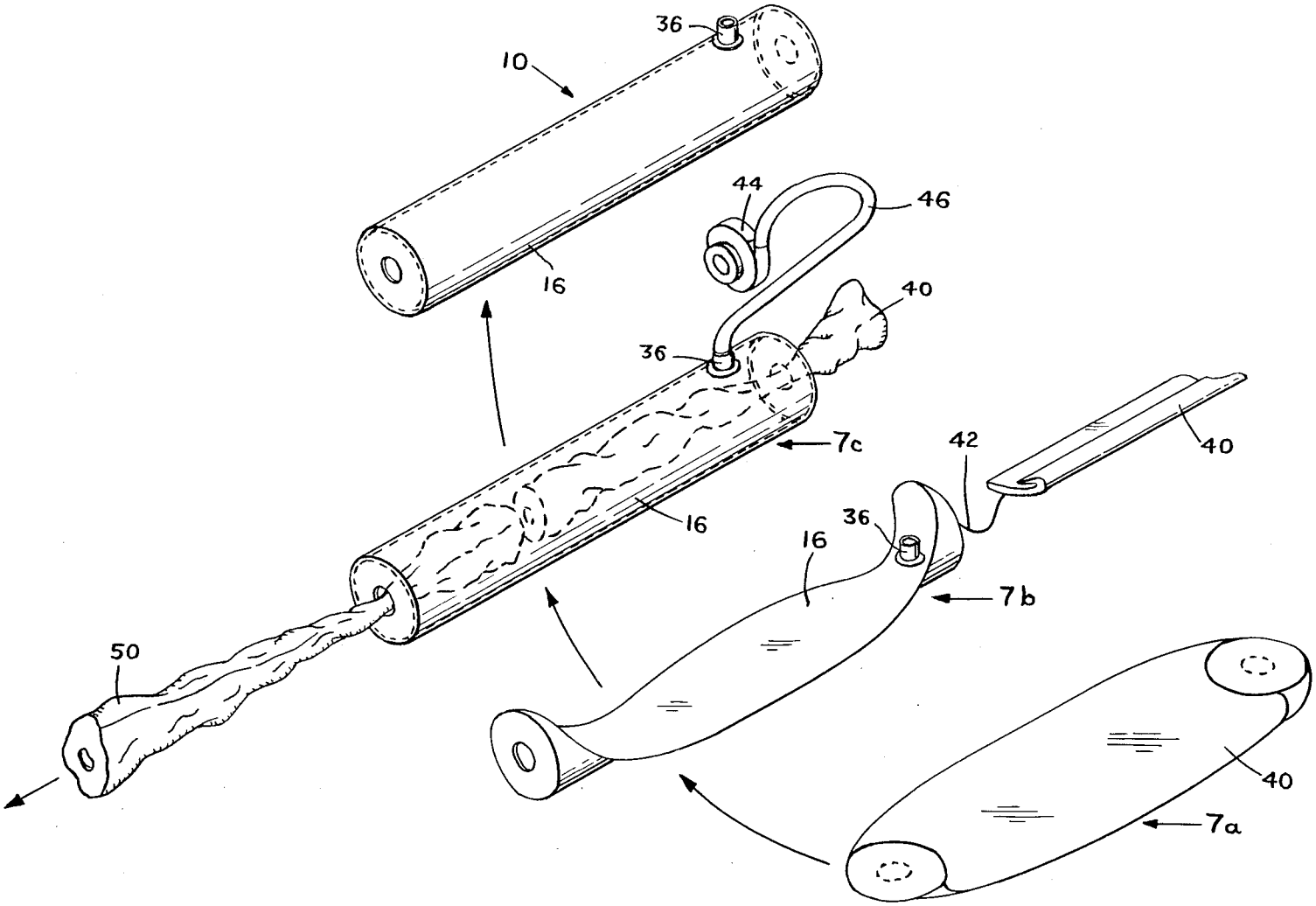
FIG. 7 is a series of schematic views showing a technique for inserting a liner within a flexible container system structured in accordance with the present invention.

Referring now to FIG. 7 there is shown a flexible container with respect to which it is desirous to provide a liner for use. This use is often desirable when toxic chemicals are to be transported, perishable foods or other easily-contaminated materials.

Thus in FIG. 7*a* there is shown a liner 40 which may be utilized with respect to a flexible container such as flexible container 16. Liner 40 may be taken from the position shown in FIG. 7*a* and folded to the position shown in FIG. 7*b* such as to be capable of being passed through the fill-discharge port of flexible container 16. A lead line 42 may be utilized attached to liner 40 or, alternatively, where flexible container 40 is being utilized to replace a previously inserted liner, the liner 40 may be connected to the previously inserted liner by a suitable means (not shown).

With liner 40 so disposed, flexible container 16 is partially inflated through the use of a suitable fan 44 which is connected through a hose 46 to vent means 36. The passage of air into the flexible container causes its partial inflation to facilitate movement of the liner therethrough. More specifically, with the flexible container inflated as shown in FIG. 7*c* either lead line 42 or a previously inserted liner 50 is pulled through the opening for the clean-out plate 34 thus causing liner 40 to be introduced within the container through the opening for fill-discharge connection 32. Once liner 40 is completely contained within flexible container 16 the lead line 42 or prior liner 50, as the case may be, is disconnected and the container is set up for use by the reinstallation of the fill-discharge connections and the clean-out plate.

As will be recognized by those skilled in these arts the utilization of a liner is thus extremely simple and permits the flexible container to be utilized for a plurality of varied types of cargos with a minimum requirement for cleaning and a very short turn around time.

The flexible container system in accordance with the invention will be recognized by those skilled in these arts as a significant advance over the state of the art by reason of the flexibility offered and the stability achieved by providing plural flexible containers of generally cylindrical shape and having restricted transverse dimensions slightly greater than the transverse dimension of the cargo container in which the flexible containers are to be utilized. It will also be recognized by those skilled in these arts that the utilization of such plural containers is not restricted merely to standard cargo containers but is useful with other types of rigid containers with respect to which it is desired to transport fluids.

By providing plural elements the unrestricted transverse dimension of which, when totaled, is slightly larger than the dimension of the rigid cargo container, a wedging effect is achieved which effectively places the system in a slightly pressurized condition thus reducing any sloshing or dynamic motion during transport.

It will be further recognized by those skilled in these arts that many modifications and variations can be made to the preferred embodiment disclosed above without departing from the spirit and scope of this invention.

What is claimed is:

1. Flexible container means for shipping fluids within a rigid cargo container having walls with outer and inner surfaces defined by length, width and height dimensions comprising:

a first flexible container:

a second flexible container;

said first and second flexible containers having a longitudinal dimension and a transverse dimension, and wherein the sum of the transverse dimensions of said first and second flexible containers filled and unconstrained is the same or slightly greater than the width dimension of the rigid cargo container in which said first and second flexible containers are to be received, where said first and second flexible containers when filled are engaged in firm surface-to-surface contact with each other and with said rigid cargo container and further where said flexible containers act one upon the other in cog-like fashion to impart a counter-rotating force when said flexible containers experience a moment about their longitudinal dimensions;

a fill-discharge means mounted in one end of each of said first and second flexible containers;

a clean out means mounted in a second end of each of said first and second flexible containers; and vent means mounted in each of said first and second flexible containers.

2. Flexible container means according to claim 1 and further including liner means disposed within one of said first and second flexible containers, said liner means being insertable and removable into and from said flexible container through said fill-discharge means and said clean out means.

3. Flexible container means according to claim 1 wherein said first and second flexible containers are capable of being rolled for storage when not in use.

4. Flexible container means according to claim 1 wherein said first and second flexible containers are generally cylindrical in transverse cross-section.

* * * * *